US006220278B1

(12) United States Patent
Sauter et al.

(10) Patent No.: US 6,220,278 B1
(45) Date of Patent: Apr. 24, 2001

(54) TOP MOUNTING FAUCET ASSEMBLY

(75) Inventors: Bruce M. Sauter, Elgin; Michael T. Seum, Lockport, both of IL (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/482,433

(22) Filed: Jan. 13, 2000

(51) Int. Cl.[7] ..... E03C 1/04

(52) U.S. Cl. ..... 137/315.12; 4/677; 137/359; 137/801

(58) Field of Search ..... 4/677; 137/315.12, 137/359, 801

(56) References Cited

U.S. PATENT DOCUMENTS 4,557,288 12/1985 Botnick .
4,760,861 8/1988 Botnick .
5,232,008 8/1993 Jeffress et al. .
5,458,154 10/1995 Niemann et al. .
5,465,749 11/1995 Sauter et al. .
5,946,746 9/1999 Bloom .

FOREIGN PATENT DOCUMENTS 2250865 11/1973 (FR) .

*Primary Examiner*—Gerald A. Michalsky
(74) *Attorney, Agent, or Firm*—Quarles & Brady LLP

(57) ABSTRACT

A top mountable faucet for mounting on a sink or countertop having a wall with an opening, a supporting surface at one side, and a clamping surface at an opposite side. The faucet includes a base adapted to be positioned on the supporting surface. A body extends from the base, and includes a lip spaced from said base. An escutcheon surrounds the body and is interposed between the base and the lip. A clip is interposed between the escutcheon and lip to lock the escutcheon over said base.

3 Claims, 2 Drawing Sheets

FIG. 3
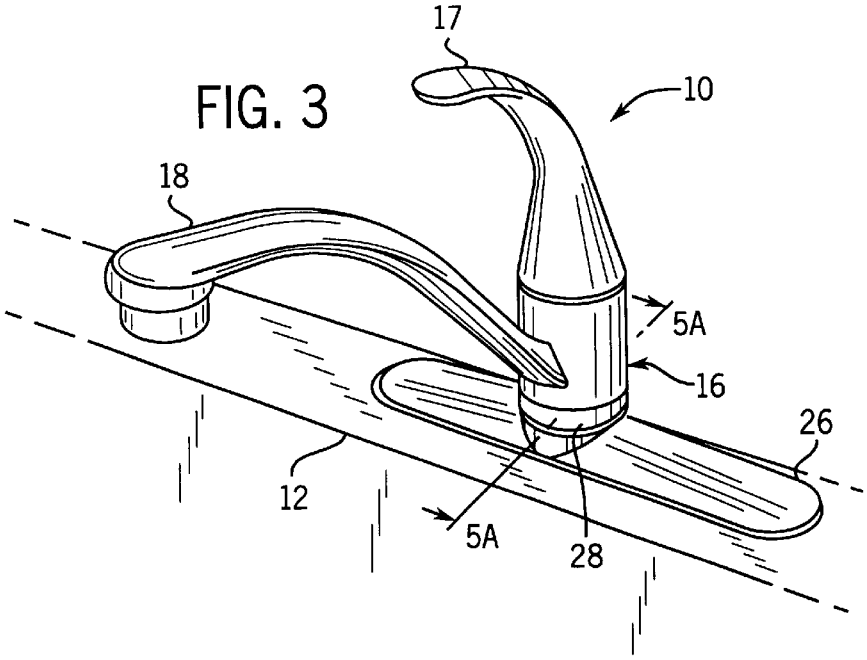
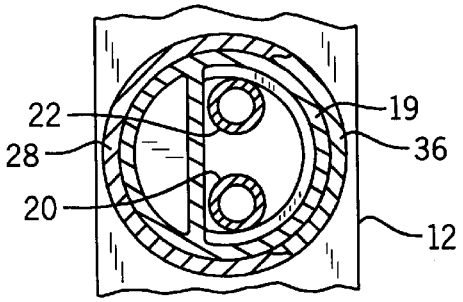
FIG. 6
FIG. 5A
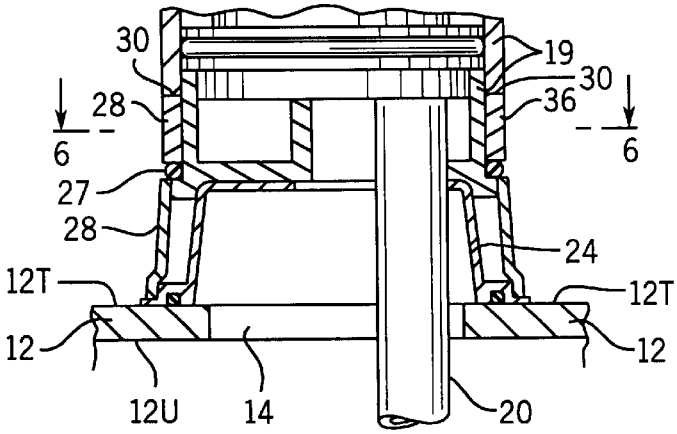
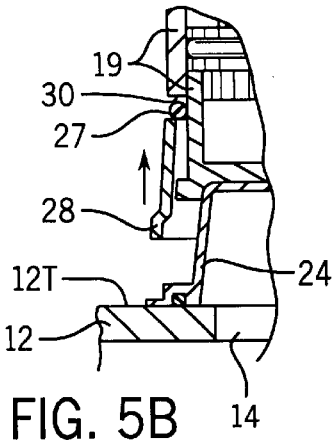
FIG. 5B

TOP MOUNTING FAUCET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to an assembly for mounting faucets to a sink, countertop or the like without the need for access to the undersink area.

The installation of faucets had typically required that work be performed by lying on one's back in order to reach dark and cramped undercounter areas. As such, mounting systems were developed for attaching faucets to countertops with less need for access to the undersink area. See e.g. U.S. Pat. Nos. 4,557,288 and 4,760,861. Unfortunately, most of these systems left exposed connections visible to the consumer or required the use of additional components.

U.S. Pat. No. 5,465,749 disclosed a number of faucet assemblies which could be installed from the top of the sink deck. In one embodiment a faucet was provided with a pivotable escutcheon. The faucet was clamped in place on the sink deck by rotating screws having upwardly exposed heads to draw hinge arms tight against the underside of the deck. The escutcheon was then pivoted to cover the exposed heads during normal use of the faucet.

While this system had significant advantages, a force exerted on the escutcheon (e.g. bumping against the escutcheon during cleaning) could cause it to move, thus giving the consumer concern that the faucet was not solidly attached. Furthermore, the escutcheon could rattle if jarred (e.g. if there was water hammer or other vibration in the building).

Thus, a need still exists for an improved top mountable faucet, particularly with respect to systems where the escutcheon is pivotable to hide the attachment.

SUMMARY OF THE INVENTION

In one form the invention provides a faucet suitable for mounting on a support of the type having a wall with an opening, a supporting surface at one side of the wall, and a clamping surface at an opposite side. The faucet has a base adapted to be positioned on the supporting surface, a body extending from said base and having a lip spaced from said base, and an escutcheon surrounding the body and interposed between the base and the lip. There is also a locking member interposable between said escutcheon and the lip, and a toggle assembly linked to the base and suitable to be inserted through the support opening to abut against the clamping surface and clamp the faucet on the supporting surface.

When the locking member is interposed between the escutcheon and lip, pivoting of the escutcheon is inhibited. When the locking member is not interposed between the escutcheon and lip the escutcheon may pivot from a first position where it covers a portion of the toggle assembly that extends through the base to a second position where a portion of the toggle assembly extending through the base is exposed.

In preferred forms the locking member is a snap clip which snaps around the body between the lip and the escutcheon, and there is a spacer for filling a gap left by said snap clip between the lip and the escutcheon after the snap clip snaps around the body.

The snap clip holds the escutcheon downward to inhibit its pivoting after the faucet is installed. The spacer completes the aesthetics. By removing the spacer and snap clip, one can move the escutcheon up slightly and then pivot it (thereby providing access to the mounting mechanism to remove the faucet).

An advantage of the present invention is that it provides a top mountable faucet (preferably of the single handle type) that has a pivotable escutcheon for hiding the mounting system, yet which does not permit inadvertent exposure of the internal portions of the faucet, and which minimizes unwanted rattle.

The foregoing and other objects and advantages of the invention will appear from the following detailed description. In this description reference is made to the accompanying drawings which show, by way of illustration and not limitation, a preferred embodiment of the invention. Thus, the claims should be looked to in order to judge the full scope of the invention.

DESCRIPTION OF THE DRAWINGS

FIG. 3 is a front, top perspective view of the faucet of FIG. 1, albeit fully assembled;

FIG. 5A is a schematic sectional view generally taken along line 5A—5A of FIG. 3;

FIG. 5B is a partial sectional view taken along line 5B—5B of FIG. 1; and FIG. 6 is a cross sectional view taken along line 6—6 of FIG. 5A.

DESCRIPTION OF THE PREFERRED EMBODIMENTS

Figure 1:
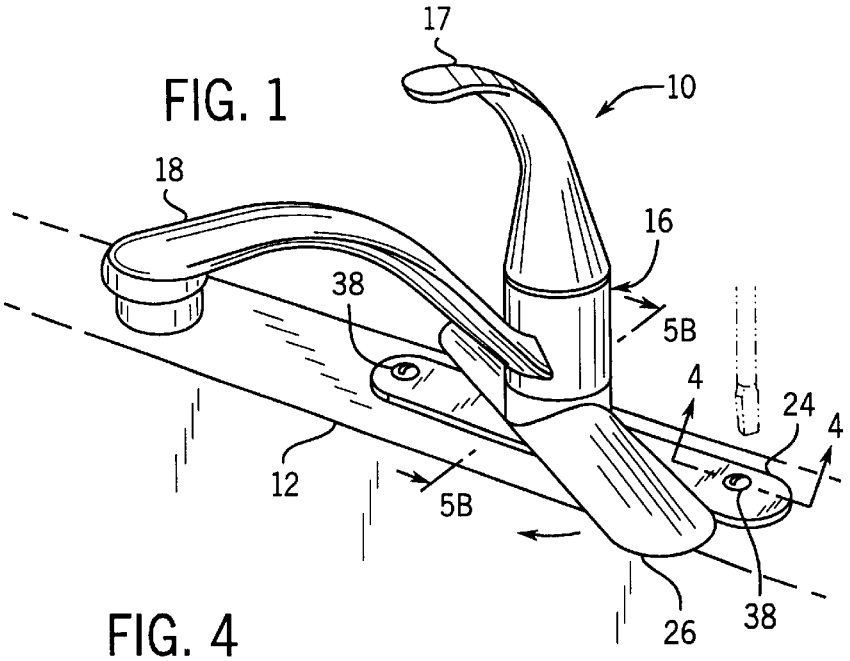
FIG. 1 is a front, top perspective view showing one embodiment of the present invention, in process of being assembled to a sink mounting ledge.

A faucet (generally 10) is shown in conjunction with a sink ledge 12 having a center access opening 14. The faucet 10 includes a body 16 for delivery of water from hot and cold inlet conduits (not shown) to a central spout 18. A control handle 17 is operatively connected to the body 16 and controls the flow of water through the spout 18. Water is supplied to the body 16 by means of the water inlet shanks (e.g. 20) which are in turn connected to respective building hot and cold inlet conduits by methods well known in the art.

Referring particularly to FIGS. 5A–6, body 16 encloses a control valve in a cylindrical housing 19. The housing 19 is mounted to base 24 which is supported on the sink ledge 12, and is surrounded by an elongated pivotable escutcheon 26.

A toggle bolt 32 is extendable through opening 34 in the sink ledge 12 to secure the faucet 10 to the sink ledge 12. The opening 34 can be one of the usual three or four holes provided in most preformed kitchen sinks. Alternatively, where the faucet is mounted directly on a countertop, the opening can be a hole through the countertop.

Figure 2:
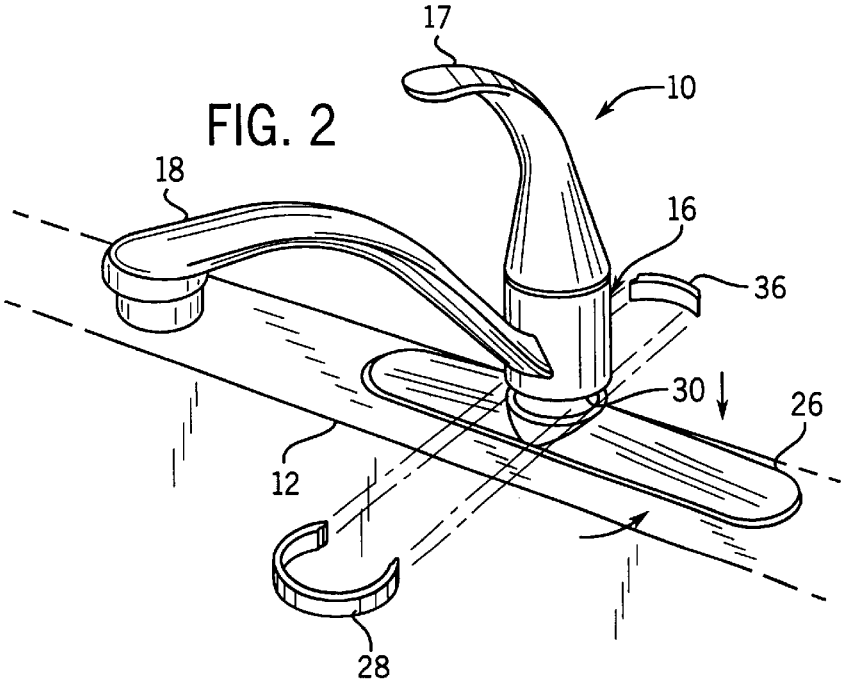
FIG. 2 is an exploded view of the faucet shown in FIG. 1, in a further stage of assembly.

The escutcheon 26 can cover/hide the base 24 in the FIG. 2 position, and can be locked in place against pivoting and vertical movement by a C-shaped snap clip 28 which is preferably made of plastic. The snap clip 28 is snapped around the housing 19 between the escutcheon 26 and a lip 30 (best shown in FIGS. 5A and 5B) formed in the housing 19.

Preferably a spacer 36 can be slipped into the gap formed by the snapped in place snap clip 28 between the lip 30 and escutcheon 26. This completes an aesthetically pleasing faucet appearance (see e.g. FIG. 3). An O-ring 27 can also be interposed between the escutcheon and snap clip 28 to flexibly urge the escutcheon 26 against the base 24 to further inhibit the escutcheon 26 from rattling.

Figure 4:
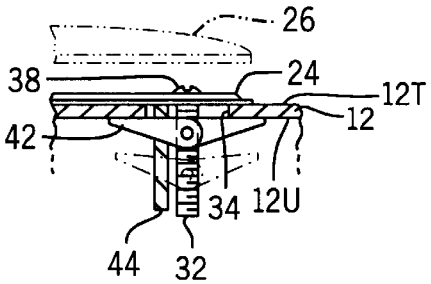
FIG. 4 is a partial sectional view taken along line 4—4 of FIG. 1.

To mount the faucet 10 onto the sink ledge 12 the inlet conduits would first be connected to the water inlet shanks 20 and 22 by projecting hoses from the conduits up through the center opening 12. After the connection, the faucet 10 can then be lowered until the base 24 contacts the upper surface 12T of the sink ledge 12. While lowering the faucet a toggle bolt 32 depending down through the base 24 is slipped through the sink ledge aperture 34. This can be achieved because wings of the toggle bolt can pivot up towards each other on horizontal pivots to permit them to pass through the aperture 34. Once through the apertures the toggle arms swing out and down to the FIG. 4 position.

When the base 24 is resting on the sink ledge 12, snap clip 34 can be removed and the escutcheon 26 slightly lifted (as shown in FIG. 5B) and rotated to expose the toggle bolt head 38. The bolt 32 is rotated by a screwdriver rotating head 38 to cause the toggle members 42 to ride upwardly on the bolt 32 until they engage the underside 12U of the sink ledge 12. Extension 44 depending downwardly from the base 24 through the aperture 34 prevents the toggle member 42 from merely rotating along with the bolt 32.

The base 24 can then be covered by rotating, and then lowering, the escutcheon 26 over the base 24. The snap clip 28 is then snapped into place between the escutcheon 26 and manifold lip 30 to prevent the escutcheon 26 from lifting off of the base 24. The spacer 36 is then snapped into the gap formed by the snap clip 28.

To remove the faucet 10 from the sink ledge 12 (for replacement or repair), the spacer 36 and snap clip 28 are removed, and the escutcheon 26 is then raised and pivoted to expose the toggle bolt head 38. The toggle bolt 32 is rotated to lower the toggle member 42 from the sink ledge underside 12U until the toggle member 42 drops off of the bolt ends. The faucet 10 is then lifted off of the sink ledge 12. Again, no significant access below the sink is needed.

As can be seen from the above description, the present invention provides a top mountable faucet assembly which is easily installed and removed. While the preferred embodiment has been described above, it should be readily apparent to those skilled in the art that a number of modifications and changes may be made to it without departing from the spirit and scope of the invention. For example, while the present invention has been shown as part of a faucet attached to sink, it is also adaptable for use with other types of fluid valves (e.g. a shower control valve on a vertical wall). Also, the specific materials mentioned are not the only materials which can be used (e.g. the clip may be metal).

Moreover, the cartridge valve used in connection with these assemblies is not critical. The system will work regardless of whether the valve control elements are designed to merely rotate, to rotate and slide, or to otherwise control volume and/or temperature. All such and other modifications within the spirit of the invention are meant to be in the scope of the invention.

INDUSTRIAL APPLICABILITY

The present invention provides faucets that can easily be installed on countertops, sinks and the like.

We claim:

1. A faucet suitable for mounting on a support, the support being of the type having a wall with an opening, a supporting surface at one side of the wall, and a clamping surface at an opposite side of the wall, the faucet comprising:

a base adapted to be positioned on said supporting surface;

a body extending from said base and having a lip spaced from said base;

an escutcheon surrounding said body and interposed between said base and said lip;

a locking member interposable between said escutcheon and said lip; and a toggle assembly linked to the base and suitable to be inserted through the support opening to abut against the clamping surface and clamp the faucet on the supporting surface;

wherein when the locking member is interposed between the escutcheon and lip pivoting of the escutcheon is inhibited, and when the locking member is not interposed between the escutcheon and lip the escutcheon may pivot from a first position where it covers a portion of the toggle assembly that extends through the base to a second position where the portion of the toggle assembly extending through the base is exposed.

2. The faucet of claim 1, wherein the locking member is a snap clip which snaps around the body between said lip and said escutcheon.

3. The faucet of claim 2, further comprising a spacer for filling a gap left by said snap clip between said lip and said escutcheon after the snap clip snaps around the body.

* * * * *